US005237932A

United States Patent [19]

Edwards

[11] Patent Number: 5,237,932

[45] Date of Patent: Aug. 24, 1993

[54] COLLAPSIBLE RAILING

[75] Inventor: Lawrence K. Edwards, Falls Church, Va.

[73] Assignee: Futrex, Inc., Fairfax County, Va.

[21] Appl. No.: 899,466

[22] Filed: Jun. 16, 1992

[51] Int. Cl.[5] ..... E01B 5/00

[52] U.S. Cl. ..... 104/124; 182/113; 256/59

[58] Field of Search ..... 104/124, 126, 118; 256/1, 11, 13.1, 14, 17, 59, 67, 65, DIG. 2, DIG. 6; 182/113, 106

[56] References Cited

U.S. PATENT DOCUMENTS

| | | | |
|---|---|---|---|
| 3,666,045 | 5/1972 | Olsen | 182/113 |
| 3,890,904 | 6/1975 | Edwards | 104/121 |
| 4,394,837 | 7/1983 | Edwards | 104/124 |
| 4,856,761 | 8/1989 | Berner | 256/59 |

FOREIGN PATENT DOCUMENTS

| | | | |
|---|---|---|---|
| 0079783 | 6/1980 | Japan | 182/113 |
| 0122357 | 5/1991 | Japan | 256/59 |
| 0727802 | 4/1980 | U.S.S.R. | 256/59 |

*Primary Examiner*—Mark T. Le
*Attorney, Agent, or Firm*—Senniger, Powers, Leavitt & Roedel

[57] ABSTRACT

A collapsible railing having an upper rail and a plurality of posts hingedly attached to the upper rail at spaced apart locations. A crank including a shaft portion and an arm portion which is mounted for rotation about the long axis of the shaft portion is connected to each post. An actuator actuates the motion of the crank to pivot the posts and the upper rails between a collapsed position in which each post is oriented generally horizontally, and an erect position in which the posts are in an upright position.

19 Claims, 6 Drawing Sheets

B
9
21C
21B
17
11
17
45
3
51
1
23
13
5
13
7
13
8
9a

COLLAPSIBLE RAILING

BACKGROUND OF THE INVENTION

The present invention relates generally to railings and more particularly to a collapsible railing or fence.

Railings or fences which may be necessary for safety such as when walking down steps or near the edge of an elevated structure or ground, or to prevent entrance or egress to certain areas, nevertheless can occupy needed space and detract from the appearance of the area. Where the railing or fence is needed only at certain times, it is desirable that it be removed or stowed at all other times. For example, in an elevated railway system, an emergency exit route from a passenger car, may lead to a raised walkway. Railing is needed along the walkway when being used, but is unnecessary when as is ordinarily the case, no one is on the walkway.

An elevated railway of the type to which this invention is particularly applicable is disclosed in my U.S. Pat. No. 3,890,904, which is incorporated herein by reference.

SUMMARY OF THE INVENTION

Among the several objects of this invention may be noted the provision of a collapsible railing that is unobtrusive in its collapsed or stowed position but can be quickly and easily erected; the provision of such a collapsible railing which allows passage through the railing at predetermined intervals; and the provision of such a collapsible railing which facilitates passage through the railing from below.

Generally, a collapsible railing constructed according to the principles of the present invention comprises an upper rail and a plurality of posts hingedly attached to the upper rail at spaced apart locations. A crank means for raising each post to an erect position includes a shaft portion mounted for rotation about its long axis, and an arm portion mounted on the shaft portion. The posts are mounted at one end of the shaft portion such that upon rotation of the shaft, the posts pivot. An actuator means actuates the motion of the crank means to swing the posts and the upper rails between a collapsed position in which each post is oriented generally horizontally, and an erect position in which the posts are generally upright.

Other objects and features will be in part apparent and in part pointed out hereinafter.

BRIEF DESCRIPTION OF THE DRAWINGS

Corresponding parts are designated by corresponding reference numerals throughout the several views of the drawings.

DETAILED DESCRIPTION OF THE PREFERRED EMBODIMENT

Figure 1:
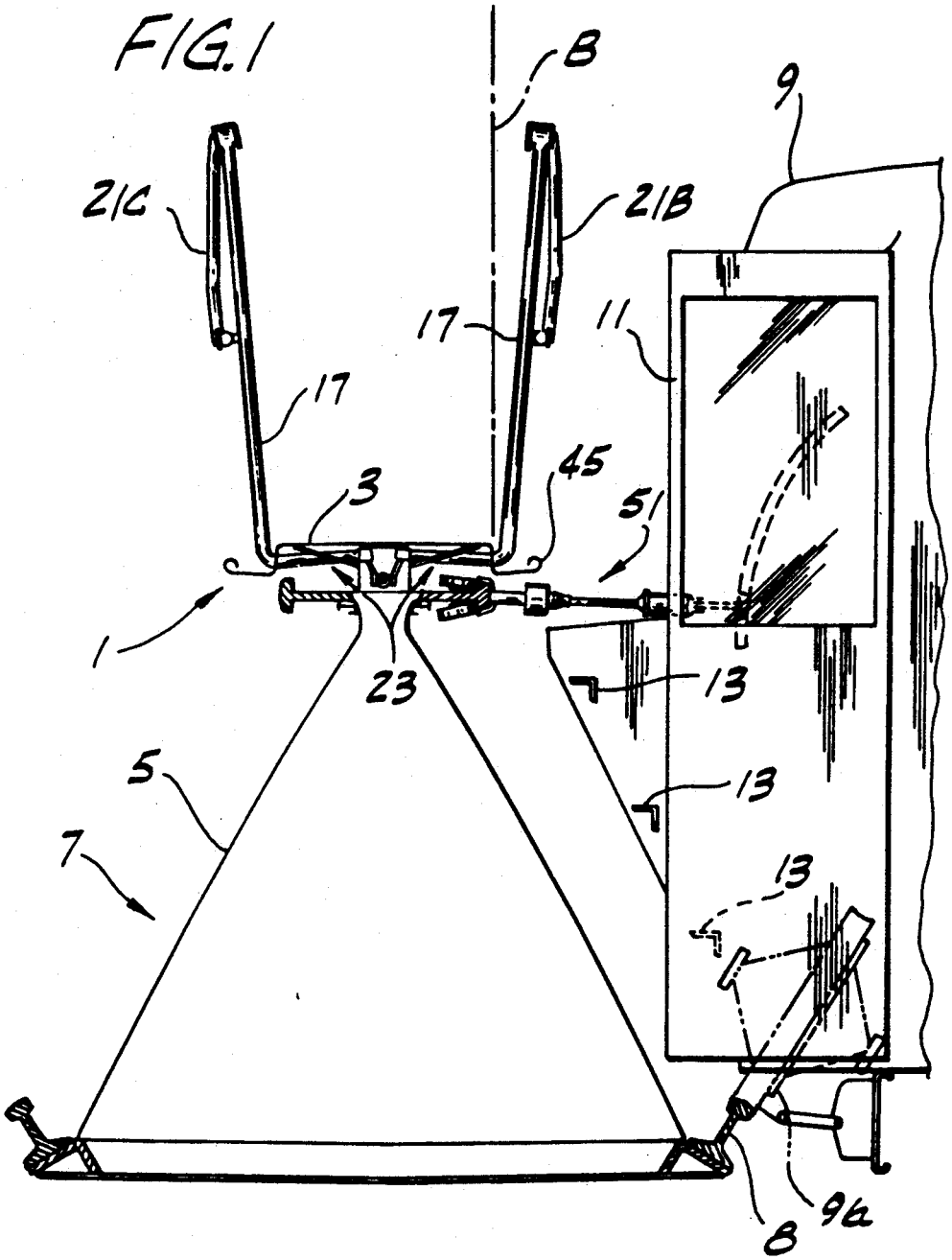
FIG. 1 is a front elevation of a collapsible railing in an elevated railway system walkway.

Referring now to the drawings, and more particularly to FIG. 1, there is generally indicated at 1 a collapsible railing on each side of a walkway 3 which is located on top of a beam 5 of an elevated railway system, generally indicated at 7. The walkway 3 is constructed of heavy sheet metal with additional reinforcement for added strength and rigidity. Although the collapsible railing shown and described is used in the context of handrails for a walkway in an elevated railway system, it is envisioned that it would be useful in other situations whenever a railing or fence is needed only at certain times. A passenger car 9 of the railway system 7 is supported by wheels such as wheel 9*a* on a rail 8 mounted on the side of the beam 5 for movement along the beam. Another passenger car (not shown) may be simultaneously supported on the opposite side of the beam 5. If there is an unexpected stop or emergency, a door 11 on the inner side of the passenger car 9 may be opened, and passengers may transfer to the walkway 3 with the assistance of steps 13 associated with the car (FIGS. 6A–6D). The steps 13, which are concealed and slide out linearly from car 9, are deployable upon command.

The collapsible railings, usually in their collapsed positions, may be erected by the train operator by a control switch (not shown) in the passenger car 9, operating a suitable remote control system of the type well known in the art. The collapsible railing provides lateral support for persons walking along the walkway and helps to prevent them from falling off of the walkway 3.

Each collapsible railing includes an upper rail 15 hingedly connected to a plurality of posts 17 spaced along the walkway 3 for pivoting relative to the posts, and a lower rail, indicated generally at 19, located generally below the upper rail when the railing is in its erected position. The lower rail 19 is hingedly connected to the posts in a fashion similar to the connection of the upper rail 15. In the preferred embodiment, the upper rail 15 extends continuously the entire length of the beam 5. The lower rail 19 includes at least two separate longitudinally aligned lower rail members, like lower rail members 19A, 19B shown in FIG. 2, for each beam 5. In the preferred embodiment, the lower rail members are longitudinally spaced apart at two locations to define openings 20 for passage through the railing and onto the walkway 3. The openings 20 and the doors 11 in the railway cars 9 have been arranged so that the operator of a train including several railway cars may stop the train with the door of each car aligned with an opening 20 in the railing.

Figure 2:
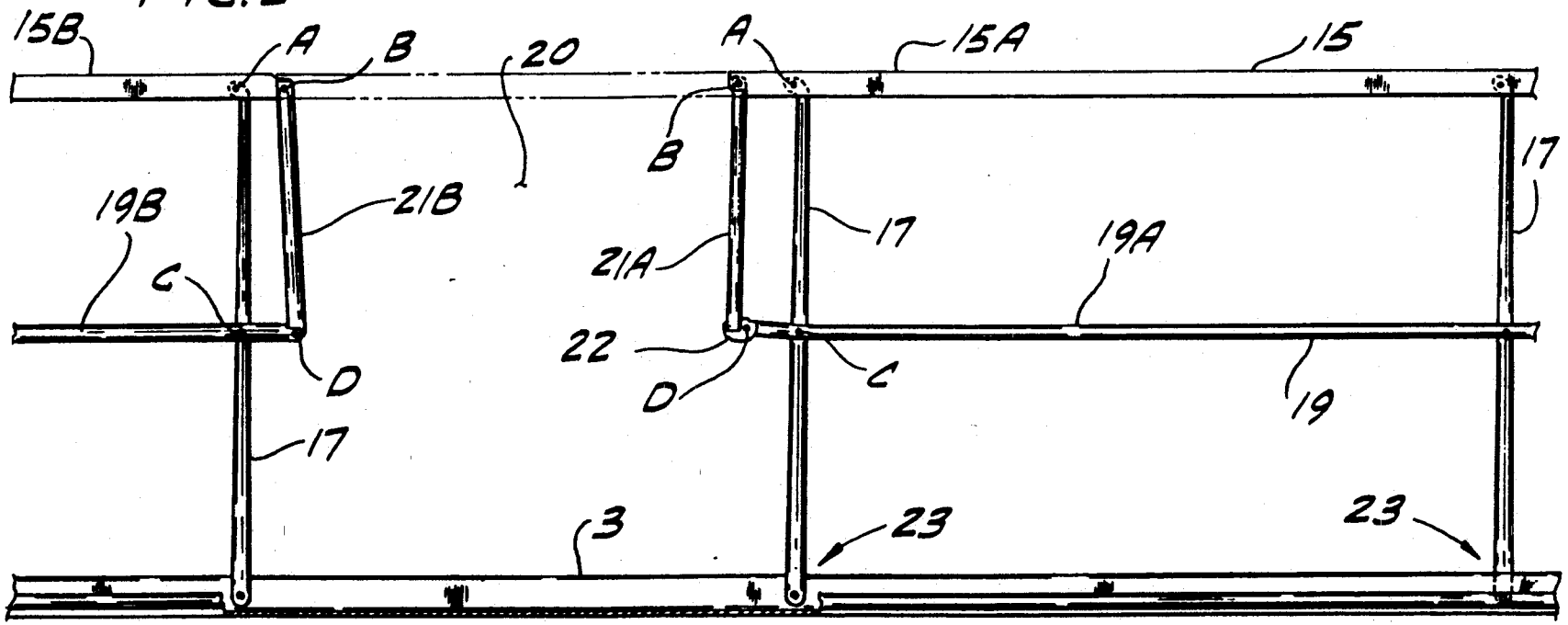
FIG. 2 is a side elevation of the collapsible railing in its erected position.
Figure 6A:
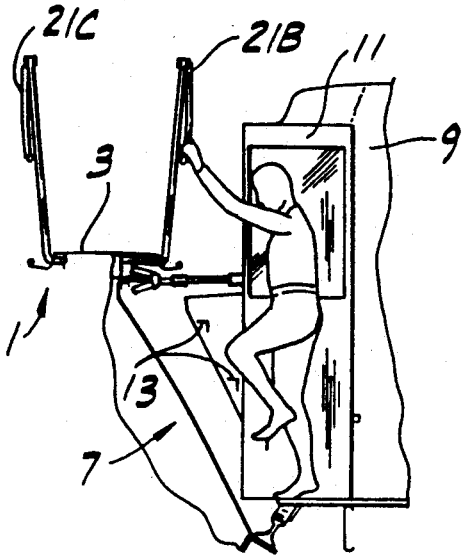
FIGS. 6A–6D are diagrammatic views illustrating a passenger entering the walkway through the railing.
Figure 6B:
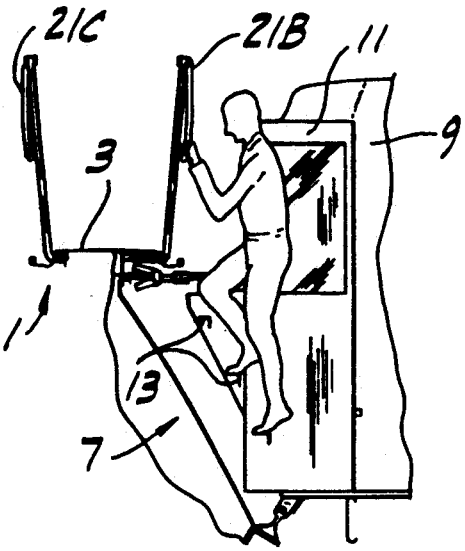
Figure 6C:
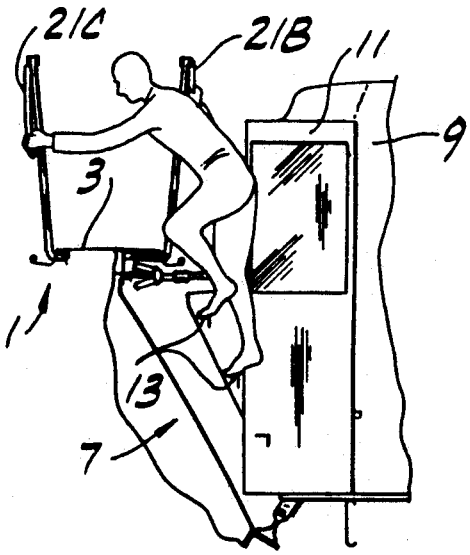
Figure 6D:
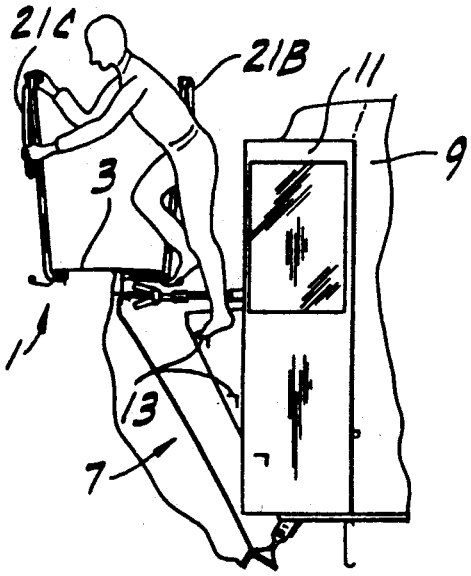
Figure 7:
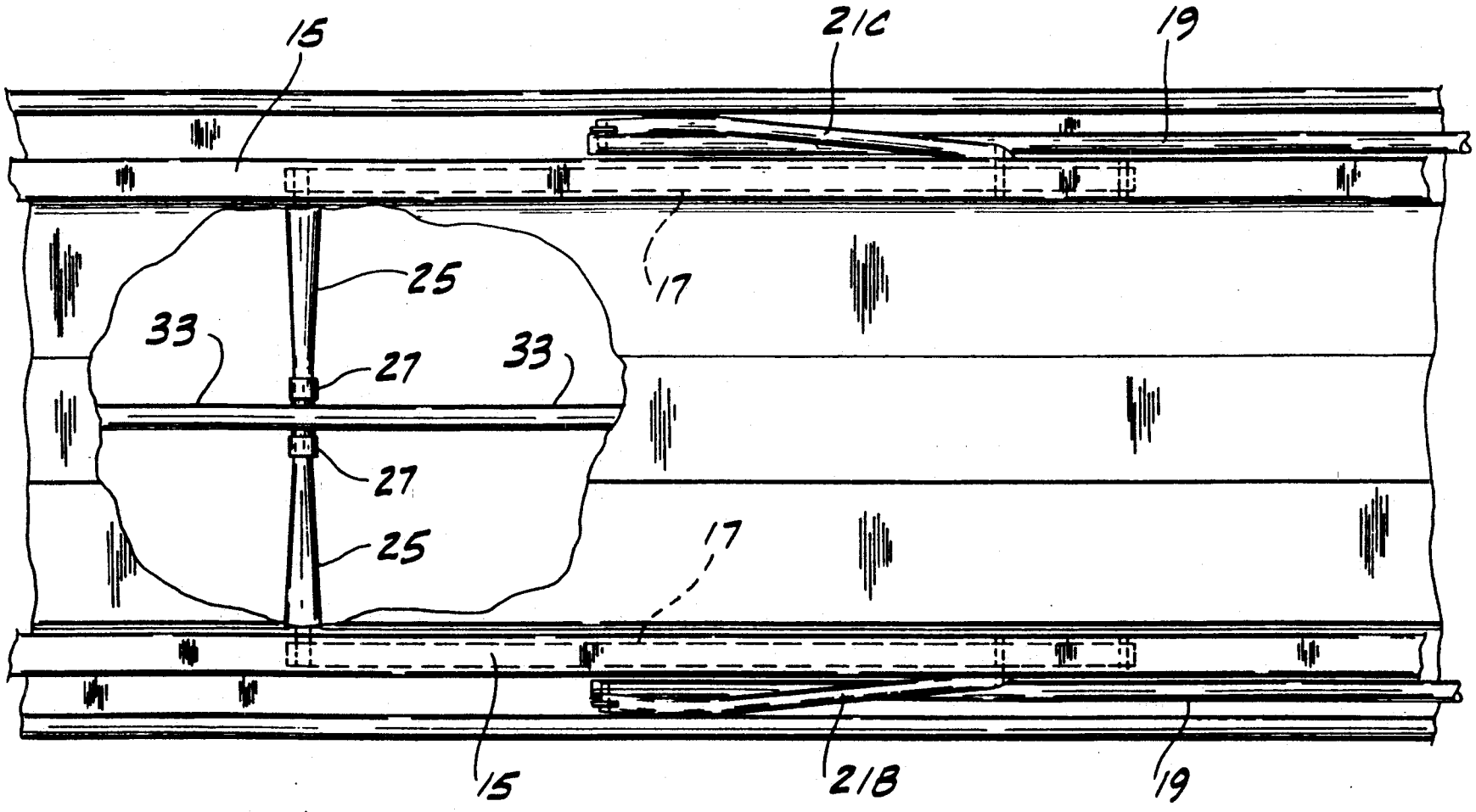
FIG. 7 is a plan view of the walkway and collapsible railing with parts broken away to show detail.

The portion of the upper rail 15 extending over the opening 20 is shown in phantom in FIG. 2. Passengers exiting the railway car 9 and climbing onto the walkway 3 pass under the upper rail 15 through the opening 20 as illustrated in FIGS. 6A–6D. Because the passengers enter the walkway 3 from below, the upper rail 15 presents no impediment to passage through the railing. To aid a passenger in climbing onto the walkway 3, handgrabs, designated 21A and 21B, respectively, are hingedly mounted at their upper ends on the upper rail 15 and at their lower ends on a respective lower rail member 19A or 19B. As shown in FIGS. 6A and 6B, a passenger may grasp the handgrabs 21A, 21B on the near side of walkway 3 while ascending the steps 13, and may use handgrabs (e.g., handgrab 21C) on the opposite side of the walkway to balance himself for the final few steps onto the walkway after the upper body has passed through the opening 20 (FIGS. 6C and 6D). However, it is to be understood that the primary purpose of the handgrabs (e.g., handgrab 21C) on the opposite side of the walkway 3 is to aid passengers exiting a railway car supported on the other side of the beam 5.

The handgrabs 21A, 21B, and portions of the upper rail 15, lower rail 19 and posts 17, define parallelograms ABCD having sides which are parallel to the sides of a parallelogram formed by the upper rail 15, the lower rail 19, adjacent posts 17 and the walkway 3. To facilitate collapse of the railing, the handgrab 21A is pivotally connected to a special hinge plate 22 which is pivotally connected to the lower rail 19A. As may be seen by reference to FIGS. 2 and 3, the hinge plate 22 allows the handgrab 21A to swing over onto the lower rail 19A as the railing is collapsed. The handgrabs 21A, 21B are spaced apart a distance suitable for allowing passengers to pass between them (e.g., 27.5 inches apart).

The configuration of the railing at the ends of the beam 5 is also illustrated in FIG. 2. There both the upper rail 15 and the lower rail 19 terminate, so that there is one upper rail 15A and one lower rail 19A on one side of the opening 20, and another rail 15B and another lower rail 19B on the opposite side. Special considerations come into play for collapse of the railing at the ends of the beam because railing on adjacent beams need not be erected or collapsed simultaneously. Therefore, among other things, the handgrabs 21A, 21B must be offset laterally of each other so that if the railing on one beam is collapsed or erected after the other, the upper end of the handgrab 21B will not hit the lower end of the handgrab 21A. In addition, to allow room for the railings on the adjacent beams to swing between their erect and collapsed positions independently of each other, the post 17 at the end of one beam is spaced apart a distance slightly farther from the adjacent post on the other beam than the spacing of adjacent posts on the same beam (e.g., 42 inches versus 36–39 inches, when the posts are approximately 40 inches in height). Moreover, the handgrabs 21A, 21B are spaced apart further (e.g., 30 inches) than they are at the openings 20 intermediate the ends of the beam 5.

Figure 3:
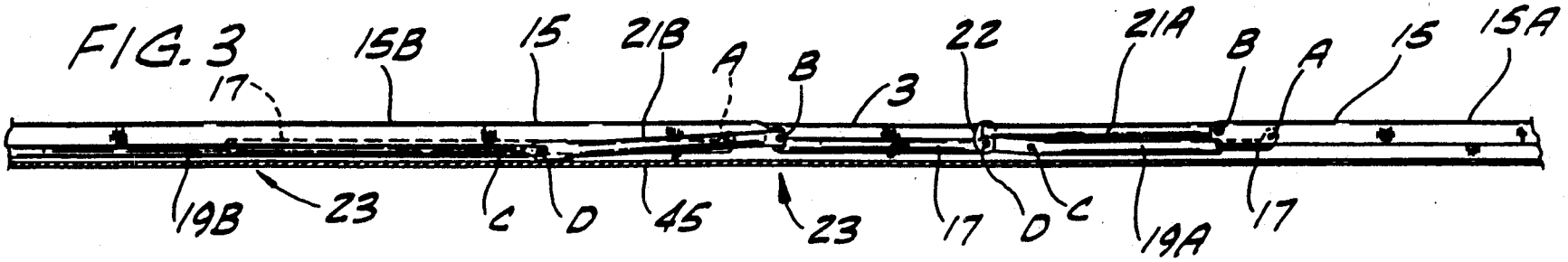
FIG. 3 is a side elevation of the collapsible railing in its collapsed position.
Figure 4:
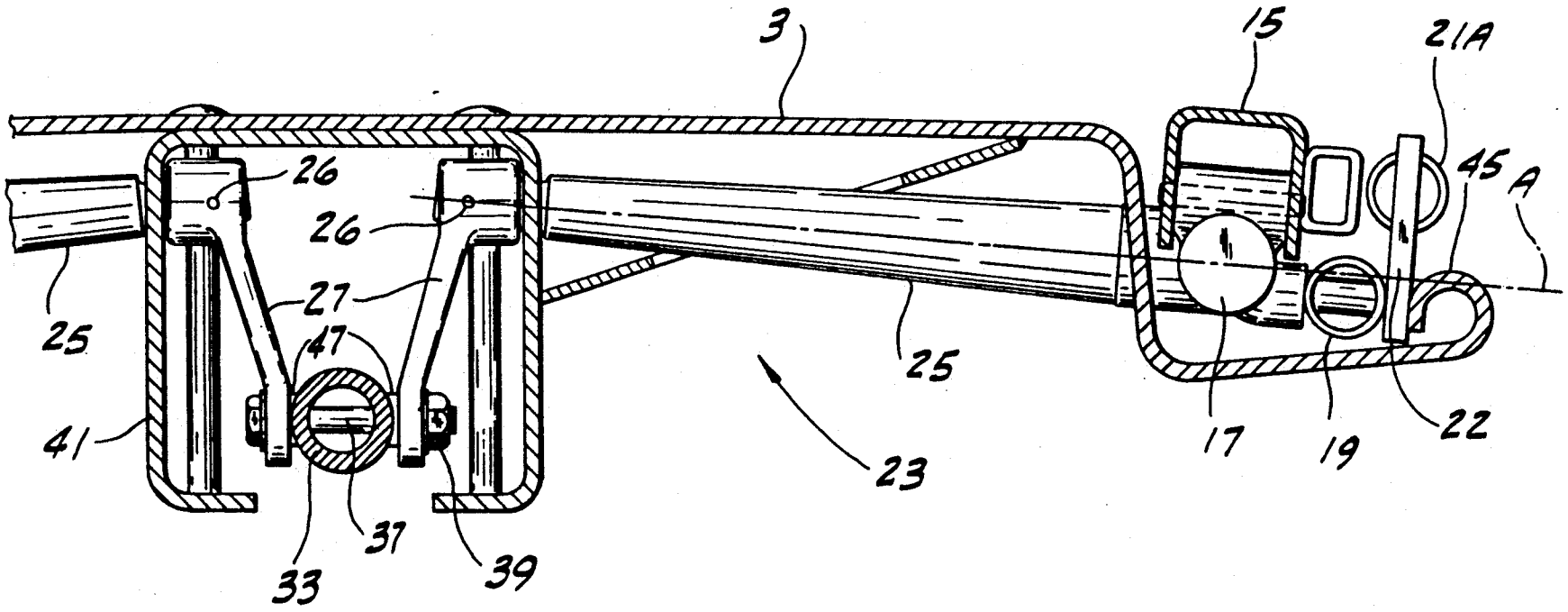
FIG. 4 is an enlarged fragmentary cross section of the walkway and collapsible railing.
Figure 5:
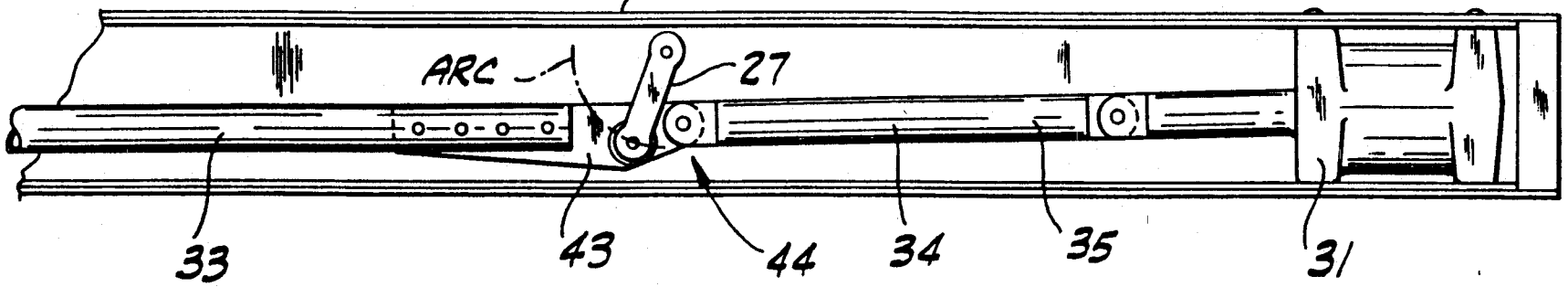
FIG. 5 is a fragmentary longitudinal section of a drive assembly of the collapsible railing.

A crank, generally indicated at 23, is provided at each post 17 (FIG. 4). The crank 23 includes a shaft portion 25 pivotally connected at its first end to a first end of an arm portion 27 of the crank by a pin 26. A second end of shaft portion 25 is fixedly connected to the second end of post 17. The shaft portion 25 is mounted near its first end in a box structure 41 and near its second end on an extension of the walkway 3 forming a trough 45, for rotation of the crank about the long axis A of the shaft portion. Driving the crank 23 is an actuator, generally indicated at 29, located within box structure 41 (FIG. 5). The actuator 29 rotates the cranks 23, to swing the posts 17, the upper rail 15, the lower rails 19, and the hand grabs 21 between a collapsed position (FIG. 3) in which the posts, upper and lower rails and hand grab are oriented in a generally horizontal plane, and an erect position (FIG. 2) in which the posts are upright and the upper and lower rails and hand grab are spaced above the horizontal plane. It is to be understood that one actuator 29 may erect upper and lower rails on both sides of the walkway.

As shown in FIG. 5, the actuator 29 comprises a drive 31 located at the end of the beam 5, an elongate drive shaft 33, and linkage 35 connecting the drive shaft 33 to the drive 31. In the preferred embodiment, the drive 31 is a hydraulic actuator. The drive shaft 33 is hingedly attached at locations along its length to second end of the arm portions 27 of the cranks 23 and is supported in the box structure 41 by the arm portions. As shown in FIG. 4, the arm portions 27 of cranks 23 on opposite sides of the walkway 3 are pivotally connected to the drive shaft 33 by a bolt 37 extending through the drive shaft and openings in the ends of the arm portions 27. The bolt 37 is secured by a nut 39. In the preferred embodiment the collapsible railing has twenty-four cranks per side on each beam 5. A fitting 43 is mounted on the end of the drive shaft adjacent drive 31. The linkage 35 is pivotally mounted at one end to the arm of the drive 31, and pivotally connected to an end of the fitting 43. The arm portion 27 of a crank adjacent the end of the drive shaft is pivotally connected to a downwardly bulging portion of the fitting 43. The drive 31 has a piston arm which moves in a linear direction along a line generally parallel to the upward-sloping extension of the fitting 43. The drive shaft 33 and fitting 43 may pivot on their hinged connections with the arm portions 27 of the cranks for moving along an arc (indicated ARC in the drawings) lying in a vertical plane corresponding to the arc swept by the second ends of the crank arm portions 27. In the preferred embodiment, linkage 35 actually consists of two elements, one of which screws into the other (not shown) to permit lengthwise adjustment.

In its collapsed position the upper rail member 15, posts 17, lower rail 19 and hand grab 21 nest together in a generally horizontal position below the plane of the walkway 3 in the trough 45 (see FIG. 3). In its preferred embodiment, the drive 31 is attached to the drive shaft 33 which runs the full length of the beam 5. To move the railing 1 to its erect position, a considerable amount of force is required. The full weight of the upper rail 15, lower rails 19, and hand grabs 21 along with approximately one-half the weight of the posts 17 must be lifted. To minimize the initial driving force and to make the actuator means 29 more compact and efficient, the arm portion 27 of the crank 23 is positioned near vertical when the railing is collapsed, providing the largest moment arm possible at the start of the stroke of the pistons arm of the drive 31. The needed driving torque for the crank 23 decreases as the railing approaches the fully erected position.

In an elevated railway system, while it is important to keep the walkway 3 relatively slender for compactness and efficiency, the upper and lower rails 15, 19 on respective sides of the walkway are ideally spaced apart farther than the width of the walkway to accommodate larger passengers or passengers with children or bulky items. The preferred way for providing the necessary spacing is to erect the posts 17 at a slope of approximately 4.5 degrees to the vertical line B (FIG. 1). The introduction of an outward slope may be accomplished in at least two ways. The first, shown in FIG. 4, is to slope the shaft portion 25 of the crank along centerline A downward at an angle of 4.5 degrees from the horizontal, which causes the posts 17 to angle outwardly when erect. Thus, upon actuation of cranks 23, the posts 17 swing laterally outwardly away from the walkway 3, such that upon reaching their generally vertical position, they are approximately 4.5 degrees to the vertical line B. A secondary approach (not shown) is to angle the laterally outer portion of shaft portion 25, relative a plane extending transversely of the walkway, rearwardly 2.25 degrees from the laterally inner portion. In that event, the shaft portion 25 is angled downwardly only 2.25 degrees from the horizontal rather than 4.5 degrees. Together these angles result in the posts 17 angling outward from the vertical by an angle of 4.5 degrees when erect.

The arms 27 rotate about the centerline A of the shaft portion 25 when they are rotated to erect the railing. If the arms 27 were rigidly attached to the shaft portion, they would move laterally away from one another as the railing is erected because of the angle of the centerline A makes with the horizontal. However, the arms 27 are pivotally attached to the shaft portion 25 and have an oversized hole (not shown) to receive the shaft portion. Thus, the arms 27 pivot slightly on the hinge 26 as they swing to erect the posts 17. Resilient bushings 47 in the bolt 37 allow the arms to move slightly on the bolt.

Referring particularly to an elevated railway system of the type disclosed in my U.S. Pat. No. 3,890,904, the length of each beam 5 is approximately 84 feet. Up to four cars comprise a train, each car length being 28 feet. A space 20 between railings on adjacent beams defines a gate or passageway through the railing and onto the walkway 3. However, to provide a gate through the railing for each car, the lower rail 19 includes three longitudinally spaced rail members, two of which (lower rail members 19A, 19B) are shown in the drawings; upper rail 15 preferably extends continuously along the length of the beam 5 to assist passengers walking along walkway 3. There is one actuator 29, one drive shaft 33, and twenty-four cranks 23 for each beam 5. Because of the lengths involved, the initial actuating force needed to raise the railings for an 84 foot beam is roughly 13,000 pounds. A sizable drive would normally be required with additional space needed for a pivoting mount that permits the vertical motion of the drive shaft. However, space is tight in the area above the beam, because of the clearance demands of the train's outrigger structure (indicated generally by the reference number 51 in FIG. 1). The solution provided by the present invention is to use a rugged, fixed, hydraulic drive 31 shown in FIG. 5. This drive 31 fits within the confines of the box structure 41 (see FIG. 5). As previously stated this requires a substantial force, nominally 13,000 pounds for an 84 foot beam. This in turn requires a substantial pressure of approximately 2500 p.s.i. and an effective drive area of nearly 5.5 square inches. The stroke of the drive 31, is determined by the geometry of the arm portion 27 of the crank, and is approximately 3.6 inches in this embodiment.

Referring now to FIGS. 6A–6B, passengers gain access to the walkway 3 through one of the openings 20 in the railing located longitudinally along the walkway. The steps 13 lead up to the trough 45 which acts as the final step before the walkway 3. The trough 45 is an extension of the walkway 3, and projects laterally on both sides of the beam 5. The trough 45 receives the upper rail 15, posts 17, lower rails 19 and hand grabs 21 in their collapsed position for at least partially concealing the rails and posts. The trough 45 further protects the outrigger structure 51 from interference by the collapsible railing.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A collapsible railing comprising:

an upper rail;

a plurality of posts hingedly attached to the upper rail at spaced apart locations;

crank means for each post, said crank means including a shaft portion and an arm portion, said shaft portion being mounted for rotation about its long axis, each post being mounted at one end of the shaft portion, said arm portion being mounted at the other end of the shaft portion; and actuator means for actuating motion of said crank means to pivot the posts and the upper rail between a collapsed position in which each post is oriented generally horizontally, and an erect position in which the posts are in an upright orientation.

2. A collapsible railing as set forth in claim 1 wherein said actuator means comprises a drive, an elongate drive shaft and linkage connecting the drive shaft to the drive, the drive shaft being hingedly attached along its length to said arm portion of said crank means.

3. A collapsible railing as set forth in claim 2 wherein the drive shaft is pivotally connected to the linkage connecting the drive shaft to the drive and supported by said arm portions of said crank means such that the drive shaft moves generally along an arc lying in a generally vertical plane including the drive shaft in response to generally linear actuation by said drive.

4. A collapsible railing as set forth in claim 3 wherein the drive is a fixed hydraulic cylinder.

5. A collapsible railing as set forth in claim 1 further comprising a lower rail hingedly attached to the posts at a location below the upper rail and adapted for movement between said collapsed position and said erect position.

6. A collapsible railing as set forth in claim 5 wherein said lower rail comprises at least two generally longitudinally aligned lower rail members, the aligned lower rail members being longitudinally spaced of each other to define an opening for passage through the railing.

7. A collapsible railing as set forth in claim 6 further comprising a hand grab member hingedly connected at its upper end to the upper rail at one side of the opening and hingedly attached to an end of the lower rail member at the same side of the opening.

8. A collapsible railing as set forth in claim 1 wherein said shaft portion slopes downwardly away from said arm portion, whereby the posts move laterally outwardly when swinging away from their collapsed position to their erect position.

9. A collapsible railing as set forth in claim 8 wherein the shaft portions slope downwardly at an angle of approximately 4.5 degrees to the horizontal.

10. A collapsible railing in combination with a walkway located on top of a beam of an elevated railway system in which a passenger car is supported to the side of the beam for movement along the beam, the collapsible railing comprising:

a pair of laterally spaced upper rails;

a plurality of posts along laterally opposite sides of the walkway, the posts on each side of the walkway being hingedly attached to one of the upper rails at locations spaced longitudinally of the walkway;

crank means for each post, said crank means including a shaft portion and an arm portion and being mounted for rotation about the long axis of said shaft portion, each post being mounted at one end of the shaft portion, said arm portion being mounted at the other end of the shaft portion; and actuator means for actuating motion of said crank means to pivot the posts and the upper rail between a collapsed position in which each post and upper rail is oriented generally horizontally, and an erect position in which the posts are in an upright position and the upper rail is spaced above a side of the walkway.

11. A collapsible railing in combination with an elevated railway system walkway as set forth in claim 10 wherein said actuator means comprises a drive, an elongate drive shaft and linkage connecting the drive shaft to the drive, the drive shaft being hingedly attached along its length to said arm portion of said crank means.

12. A collapsible railing in combination with an elevated railway system walkway as set forth in claim 11 wherein the drive shaft is pivotally connected to the linkage connecting the drive shaft to the drive and supported by said arm portions of said crank means for moving generally along an arc lying in a vertical plane including the drive shaft in response to generally linear actuation by said drive.

13. A collapsible railing in combination with an elevated railway system walkway as set forth in claim 12 wherein the drive is a fixed hydraulic cylinder.

14. A collapsible railing in combination with an elevated railway system walkway as set forth in claim 10 further comprising laterally spaced lower rails hingedly mounted on posts in respective sides of the walkway at locations below the upper rail and adapted for movement between said collapsed position in which the lower rail lies generally below the plane of the walkway, and said erect position in which the lower rail is spaced above a side of the walkway.

15. A collapsible railing in combination with an elevated railway system walkway as set forth in claim 14 wherein each lower rail comprises at least two generally longitudinally aligned lower rail members, the aligned lower rail members being longitudinally spaced of each other to define an opening for passage through the railing.

16. A collapsible railing in combination with an elevated railway system walkway as set forth in claim 15 further comprising a hand grab member hingedly connected at its upper end to the upper rail at one side of the opening and hingedly attached to an end of the lower rail member at the same side of the opening.

17. A collapsible railing in combination with an elevated railway system walkway as set forth in claim 10 further comprising trough means mounted on the elevated railway beam and extending longitudinally of the beam, said trough means being adapted to receive the upper rails and posts in said collapsed position of the railing.

18. A collapsible railing in combination with an elevated railway system walkway as set forth in claim 10 wherein said shaft portion slopes downwardly away from said arm portion, whereby the posts move laterally outwardly when swinging away from their collapsed position to their erect position.

19. A collapsible railing in combination with an elevated railway system walkway as set forth in claim 18 wherein the shaft portions slope downwardly at an angle of approximately 4.5 degrees to the horizontal.

* * * * *